US007140107B2

(12) United States Patent
Ohno et al.

(10) Patent No.: US 7,140,107 B2
(45) Date of Patent: Nov. 28, 2006

(54) STACKING-TYPE, MULTI-FLOW, HEAT EXCHANGERS AND METHODS FOR MANUFACTURING SUCH HEAT EXCHANGERS

(75) Inventors: Takayuki Ohno, Isesaki (JP); Tomohiro Chiba, Isesaki (JP); Kengo Kazari, Isesaki (JP)

(73) Assignee: Sanden Corporation, Isesaki (JP)

( * ) Notice: Subject to any disclaimer, the term of this patent is extended or adjusted under 35 U.S.C. 154(b) by 0 days.

(21) Appl. No.: 11/135,371

(22) Filed: May 24, 2005

(65) Prior Publication Data

US 2005/0263274 A1 Dec. 1, 2005

(30) Foreign Application Priority Data

May 27, 2004 (JP) ..... 2004/157911

(51) Int. Cl.
*B21D 53/04* (2006.01)

(52) U.S. Cl. ..... 29/890.039; 29/890.049; 165/153

(58) Field of Classification Search ..... 165/153, 165/183

See application file for complete search history.

(56) References Cited

U.S. PATENT DOCUMENTS 4,678,112 A 7/1987 Koisuka et al.
4,969,312 A 11/1990 Hisso et al.
5,088,193 A 2/1992 Okada et al.
5,099,576 A 3/1992 Shinmura
5,101,887 A 4/1992 Kado
5,119,552 A 6/1992 Sutou et al.
5,172,762 A 12/1992 Shinmura et al.
5,174,373 A 12/1992 Shinmura
5,211,222 A 5/1993 Shinmura
5,214,847 A 6/1993 Aoki
5,265,672 A 11/1993 Aoki
5,348,079 A 9/1994 Tanaka
5,505,254 A 4/1996 Chiba
5,632,331 A 5/1997 Shinmura
5,782,291 A 7/1998 Morita
5,785,119 A 7/1998 Watanabe et al.
5,894,886 A 4/1999 Chiba et al.
5,934,367 A 8/1999 Shimmura et al.
5,960,864 A 10/1999 Morita
5,975,197 A 11/1999 Kado
6,035,931 A 3/2000 Kado et al.
6,070,428 A * 6/2000 Higashiyama et al. ..... 62/525
6,070,659 A 6/2000 Hosoya
6,098,703 A * 8/2000 Yoshii ..... 165/153

(Continued)

*Primary Examiner*—Allen J. Flanigan
(74) *Attorney, Agent, or Firm*—Baker Botts L.L.P.

(57) ABSTRACT

In a method for manufacturing a stacking-type, multi-flow, heat exchanger, heat transfer tubes and outer fins are stacked alternately, each heat transfer tube being formed by connecting a pair of tube plates and including an inner fin therebetween. The manufacturing method includes the steps of disposing the tube plates so as to oppose each other, inserting an inner-fin forming material between the tube plates, stacking the tube plates with respect to each other so as to nip or seize the inner-fin forming material between the tube plates, and cutting the inner-fin forming material and end portions of the tube plates simultaneously. By this method, the time for required manufacturing heat transfer tubes may be reduced significantly, and the productivity of the heat exchanger may be increased significantly. The positioning of inner fins may be achieved with a high degree of accuracy. Therefore, a stacking-type, multi-flow, heat exchanger having superior performance qualities and manufactured with a high degree of reliability may be manufactured at a reduced cost.

6 Claims, 10 Drawing Sheets

U.S. PATENT DOCUMENTS 6,170,567 B1 * 1/2001 Nakada et al. ..... 165/153
6,257,325 B1 7/2001 Watanabe et al.
6,412,174 B1 * 7/2002 Kawano et al. ..... 29/890.053
6,571,473 B1 * 6/2003 Nozaki et al. ..... 29/890.049
6,823,933 B1 * 11/2004 Chiba ..... 165/153
2004/0200606 A1 * 10/2004 Higashiyama ..... 165/153
2005/0173101 A1 8/2005 Ohno
2005/0247444 A1 * 11/2005 Ohata et al. ..... 165/177
2006/0118283 A1 * 6/2006 Hanafusa ..... 165/153

* cited by examiner

STACKING-TYPE, MULTI-FLOW, HEAT EXCHANGERS AND METHODS FOR MANUFACTURING SUCH HEAT EXCHANGERS

BACKGROUND OF THE INVENTION

1. Field of the Invention

The present invention relates to a stacking-type, multi-flow, heat exchangers, each heat exchanger comprising a plurality of heat transfer tubes, each tube having an inner fin therein and outer fins which are stacked alternately between the tubes, and methods for manufacturing such heat exchangers. Specifically, the present invention relates to a process for manufacturing the heat transfer tubes, each tube having an inner fin therein, and a stacking-type, multi-flow, heat exchanger manufactured by using the methods, suitable as a heat exchanger for use in an air conditioning system, in particular, for vehicles.

2. Description of Related Art

Stacking-type, multi-flow, heat exchangers having alternately stacked heat transfer tubes, each tube having an inner fin therein and outer fins therebetween, are known, for example, as depicted in FIGS. 10–12. In a heat exchanger, thus constructed, a heat transfer tube is formed as in a known heat exchanger, as depicted in FIGS. 10 and 11. Namely, a pair of tube plates 101, each formed as depicted in FIG. 10, are disposed so as to compare each other, as depicted in FIG. 11, and the circumferential edges thereof are connected to each other to form fluid passages 102 therein. An inner fin 103 is inserted into each fluid passage 102 in order to increase the efficiency of heat exchange. Flanges 104 are formed on tube plates 101 at the end portions of each tube plate 101 in its width direction. Flanges 104 are disposed at the front and rear positions in the direction of air flow 40, as depicted in FIG. 12, which is viewed along Line A—A of FIG. 8. Thus, a known heat transfer tube 105 is constructed, for example, as disclosed in Japanese Patent Application No. JP-A-2002-267383.

Such a known heat transfer tube 105 is manufactured, for example, as depicted in FIG. 13. The manufacturing method shown in FIG. 13 has the following steps:

Step 11 (S11): Tube plates 101 and 101' and inner fins 103 are made as complete parts, separately, and plates 101 and fin 103 are provided in a tube assembling process.

Step 12 (S12): Inner fins 103 are grasped by insertion arm 106 and conveyed toward tube plates 101 and 101'.

Step 13 (S13): Inner fins 103, conveyed by insertion arm 106, are disposed on a first or lower-side tube plate 101 within predetermined cavities so as not to be shifted from the predetermined positions.

Step 14 (S14): Insertion arm 106 is returned to its initial position.

Step 15 (S15): After insertion arm 106 is withdrawn from between tube plates 101, a second or upper-side tube plate 101' disposed onto the lower-side tube plate 101.

Step 16 (S16): The pair of tube plates 101 and 101' are secured temporarily to each other, so that the configuration of the heat transfer tube formed by the pair of tube plates 101 and 101' is not disturbed during the stacking of a plurality of heat transfer tubes and a plurality of outer fins alternately, for example, temporarily secured by caulking to each other by crimping.

In such a method for manufacturing a heat transfer tube, however, at least the following problems remain:

(1) As the number of heat transfer tubes used per heat exchanger increases, the time for assemble increases, and the productivity declines.

(2) It is difficult to accurately position inner fins within the predetermined cavities of the fluid passage forming portions of a tube plate during of the above-described S13.

(3) A positional shift of an inner fin may occur during the covering of first-tube plate 101 with second tube plate 101' at above-described S15.

SUMMARY OF THE INVENTION

Accordingly, a need has arisen to provide a method for manufacturing stacking-type, multi-flow, heat exchangers, which reduces the manufacturing time for a heat transfer tube, thereby increasing the productivity of the heat exchanger manufacturing method, which facilitates the positioning of inner fins being disposed at predetermined positions in each tube plate, and which prevents a positional shift of the inner fins after the inner fins are so positioned, and to provide stacking-type, multi-flow, heat exchangers, which are manufactured by using this manufacturing method.

To satisfy the foregoing need and to achieve other objects, a method for manufacturing a stacking-type, multi-flow, heat exchanger, according to the present invention, is provided. The stacking-type, multi-flow, heat exchanger comprises a plurality of heat transfer tubes and a plurality of outer fins, which are stacked alternately. Each heat transfer tube is formed by connecting a pair of tube plates to form a fluid passage in each heat transfer tube, and each heat transfer tube has an inner fin, which extends in a longitudinal direction of the pair of tube plates, in the fluid passage. The manufacturing method comprises the steps of disposing the pair of tube plates so as to oppose each other; inserting an inner-fin forming material between the pair of opposing tube plates; stacking the pair of tube plates with respect to each other so as to nip or seize the inner-fin forming material between the pair of tube plates; and cutting the inner-fin forming material and end portions of the pair of tube plates substantially simultaneously.

In this method, it is preferred that the stacked pair of tube plates are temporarily secured simultaneously with the cutting at the above-described cutting step. As a result, the manufacturing method may be further simplified.

Further, it is preferred that at least one end portion of each heat transfer tube in a width direction of the heat transfer tube is formed as a shape linearly extending in an outward or lateral direction. In such a structure, the nipping or seizing of the inner-fin forming material between the pair of tube plates may be facilitated, and the cutting of the inner-fin forming material and the end portions of the pair of tube plates simultaneously also may be facilitated.

Moreover, it is preferred that the inner-fin forming material is formed as a portion of a continuous material extending in a width direction of each heat transfer tube, and after the continuous material is inserted between the pair of opposing tube plates, the continuous material and the end portions of the pair of tube plates are cut simultaneously. In this case, it is more preferable that wavy or undulating portions and linear portions are arranged alternately in each portion of the continuous material in a width direction of each heat transfer tube. After the continuous material is inserted between the pair of opposing tube plates, the continuous material and the end portions of the pair of tube plates are cut simultaneously at a position of a linear portion of the continuous material.

In the method according to the present invention, a plurality of heat transfer tubes are formed by continuously feeding the continuous material in a width direction of each of the heat transfer tube plates and repeating the steps of claim 1.

A stacking-type, multi-flow, heat exchanger, according to the present invention, is manufactured by using such a method.

In the method for manufacturing a stacking-type, multi-flow, heat exchanger, according to the present invention, the time required for manufacturing heat transfer tubes may be reduced significantly, and by reducing the manufacturing time, the productivity of the method for manufacturing the heat exchanger may be increased significantly. Moreover, the positioning of inner fins at the predetermined positions on a tube plate may be facilitated and may be carried out with a high degree of accuracy. Further, a positional shift of an inner fin at the time of manufacturing a heat transfer tube may be prevented readily.

Therefore, a stacking-type, multi-flow, heat exchanger, manufactured by using this method, may be produced at a high productivity and at a low cost. In addition, a heat exchanger, having a high degree of reliability in the positional accuracy of inner fins and other components and having a high quality, may be provided.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only and are not intended to limit the present invention.

DETAILED DESCRIPTION OF PREFERRED EMBODIMENTS

Figure 8:
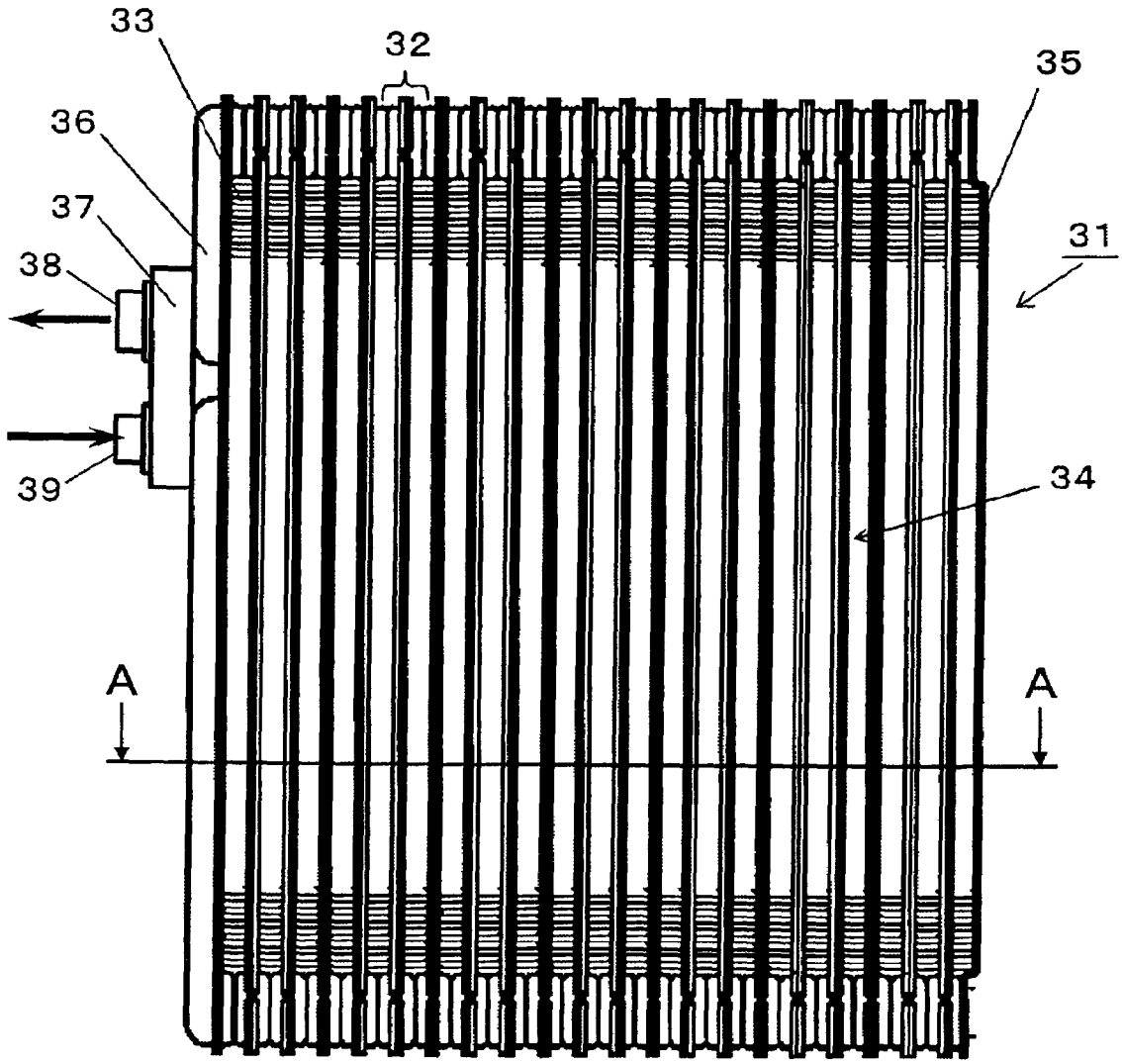
FIG. 8 is a plan view of a stacking-type, multi-flow, heat exchanger, showing elements of the structure of such a heat exchanger common to a known heat exchanger and the present invention.
Figure 9:
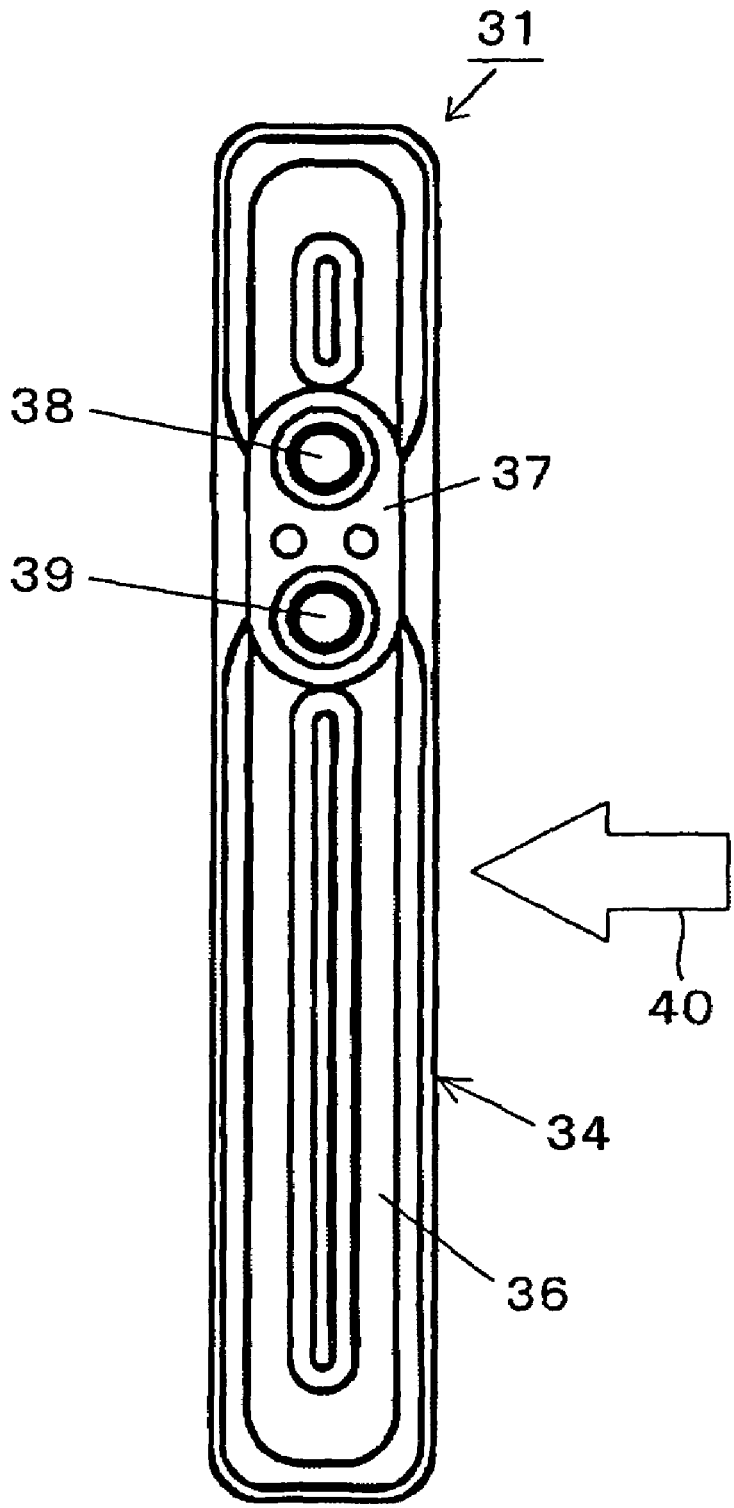
FIG. 9 is a side view of the heat exchanger depicted in FIG. 8.
Figure 10:
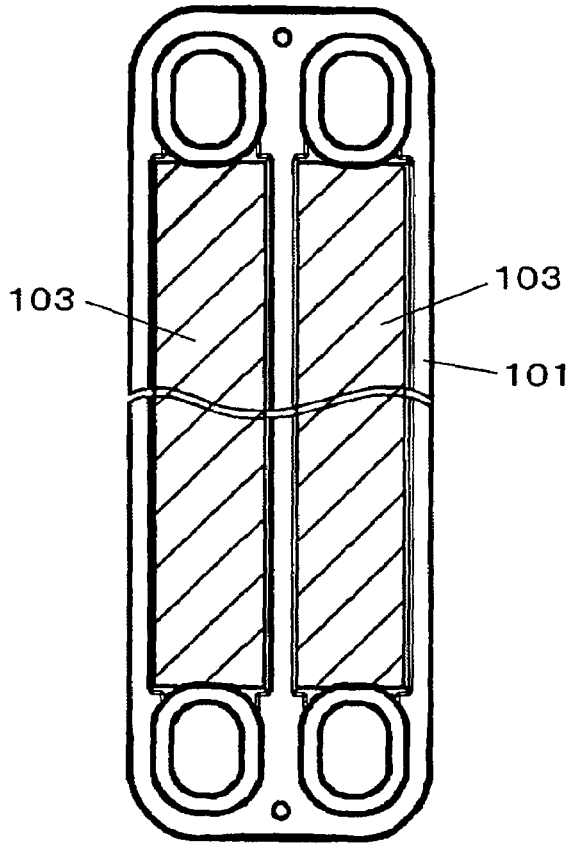
FIG. 10 PRIOR ART
FIG. 10 is a plan view of a tube plate and an inner fin for use in a known heat exchanger.
Figure 11:
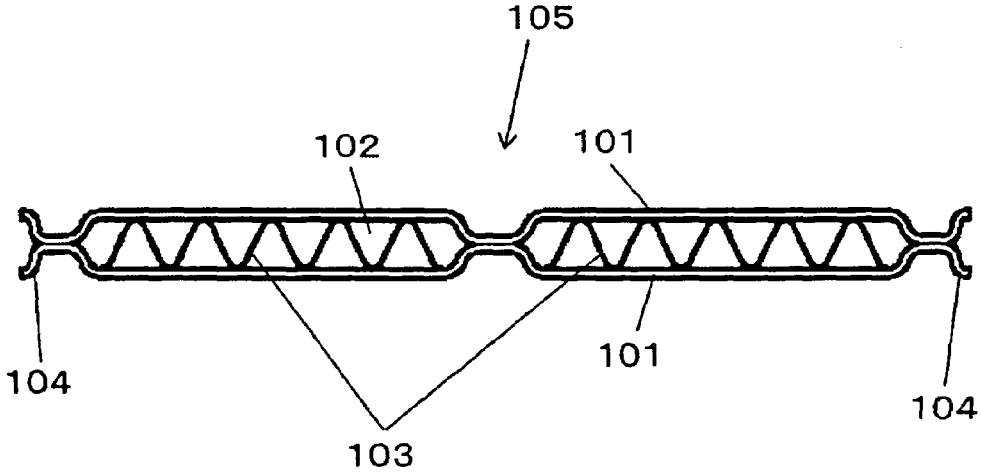
FIG. 11 PRIOR ART
FIG. 11 is a cross-sectional view of a known heat transfer tube.
Figure 12:
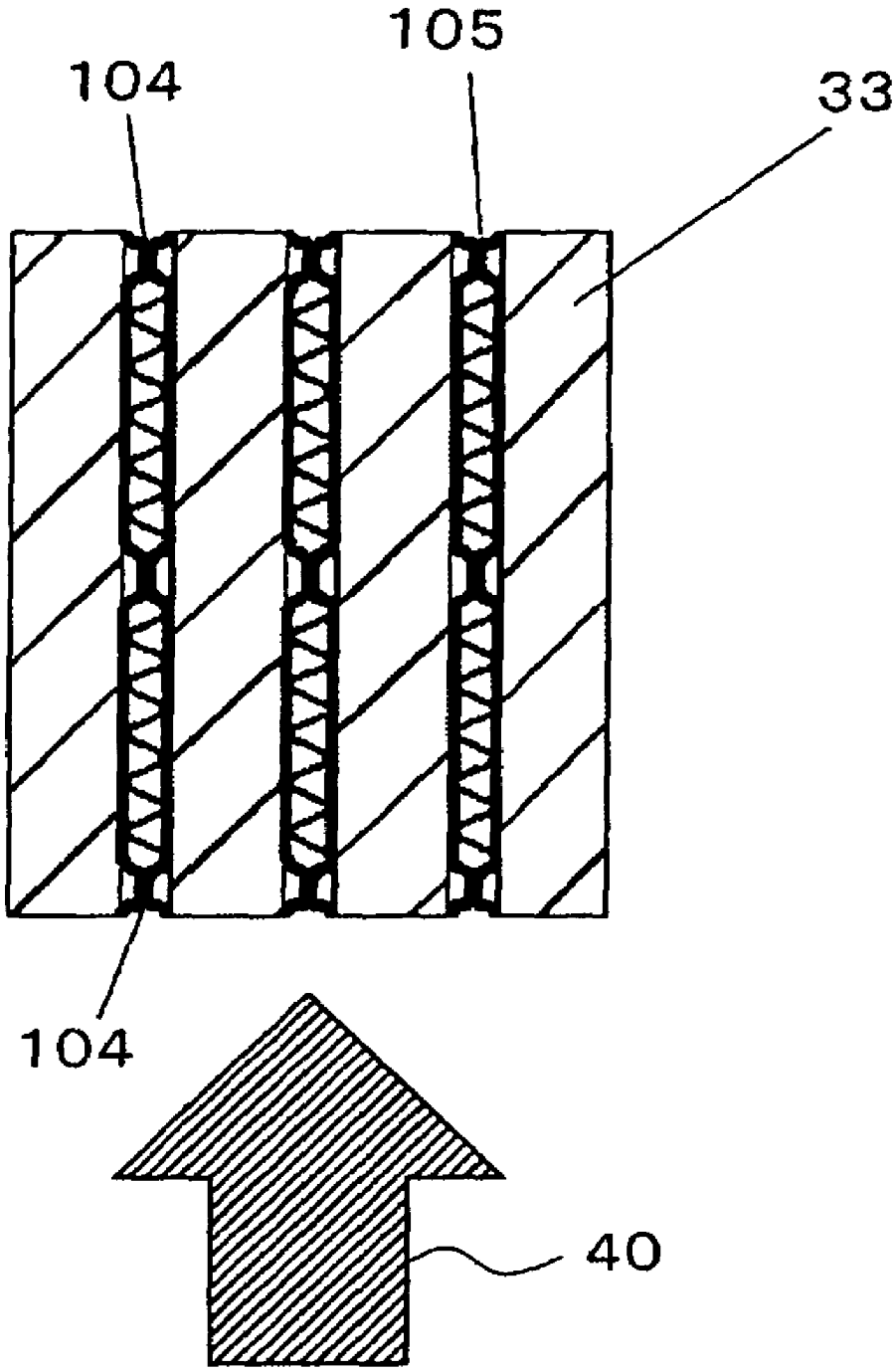
FIG. 12 PRIOR ART
FIG. 12 is a partial, cross-sectional view of a heat exchanger manufactured using the heat transfer tubes depicted in FIG. 11, as viewed along Line A—A of FIG. 8, showing an example of the disposition of the heat transfer tubes.

Because FIGS. 8 and 9 are figures common to the related art and the present invention, the structure depicted in these figures is described below. In a stacking-type, multi-flow, heat exchanger 31, as depicted in FIG. 8, a plurality of heat transfer tubes 32 and a plurality of outer fins 33 are stacked alternately to form a heat exchanger core 34. An end plate 35 and side tank 36 are connected to the outer sides of heat exchanger core 34. An inlet port 38 for introducing fluid (for example, refrigerant) into heat exchanger 31 and an outlet port 39 for discharging the fluid from heat exchanger 31 are provided on side tank 36, and a flange 37 for connecting an expansion valve (not shown) is mounted onto side tank 36. As depicted in FIG. 9, air flows in the direction shown by arrow 40, from the front side of heat exchanger core 34 of heat exchanger 31 towards the rear side of heat exchanger core 34, thereby carrying out the heat exchange between the air flowing through and the fluid flowing in heat exchanger core 34. As afore-mentioned, a structure of a stacking-type, multi-flow, heat exchanger, which is achieved with a method according to the present invention, is substantially similar to that depicted in FIGS. 8 and 9.

Figure 1:
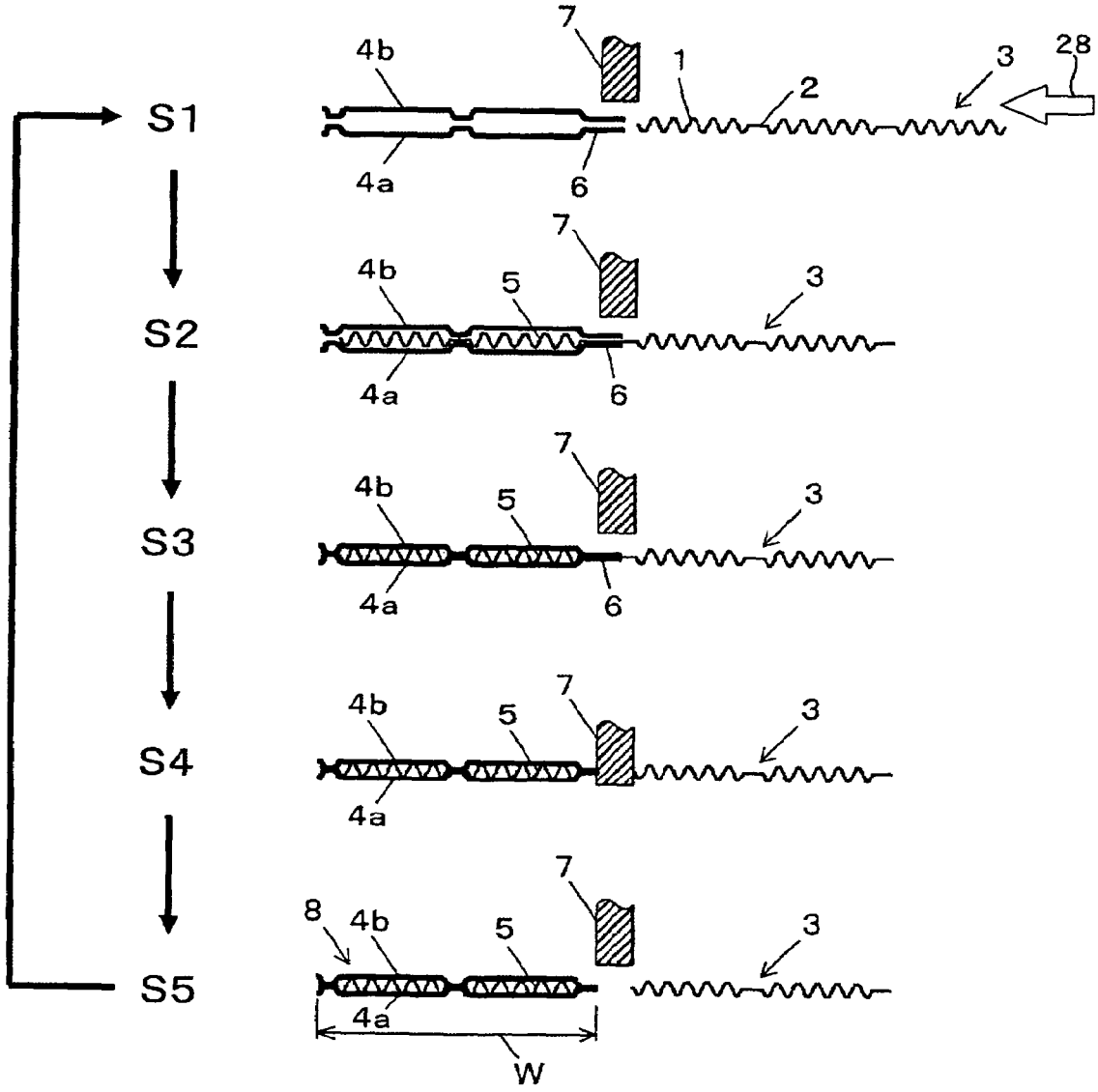
FIG. 1 is a schematic diagram, showing steps for manufacturing a heat transfer tube in a method for manufacturing a stacking-type, multi-flow, heat exchanger, according to a first embodiment of the present invention.
Figure 2:
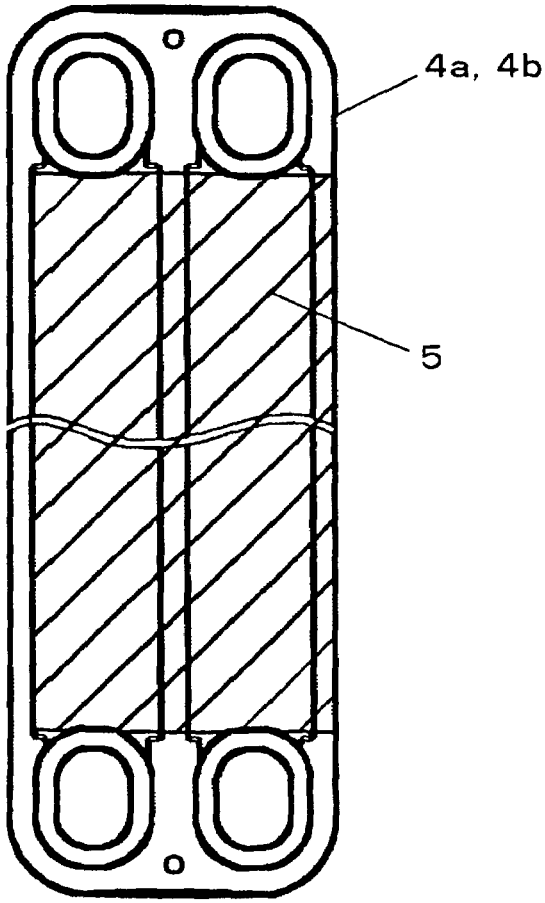
FIG. 2 is a plan view of a tube plate and an inner fin for use in the method depicted in FIG. 1.
Figure 3:
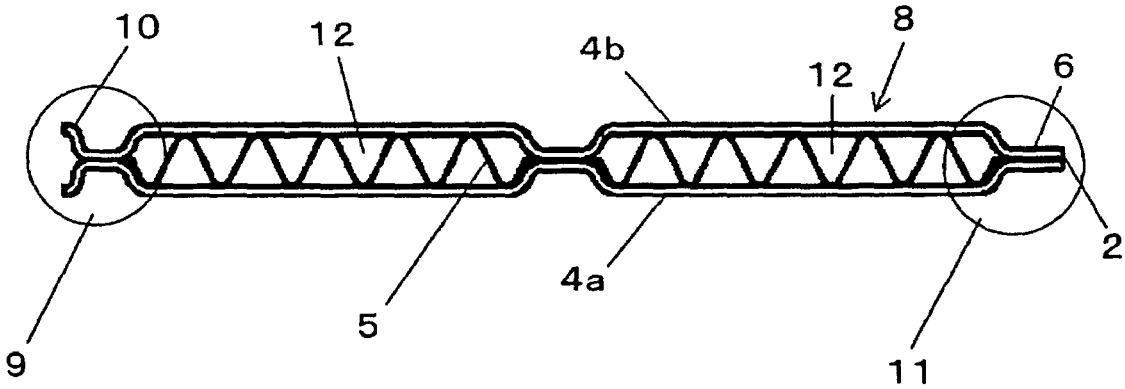
FIG. 3 is a cross-sectional view of a heat transfer tube manufactured by the process depicted in FIG. 1.

Referring to FIGS. 1–3, a method for manufacturing a stacking-type, multi-flow, heat exchanger is depicted according to a first embodiment of the present invention. FIG. 1 depicts steps of a process for manufacturing a heat transfer tube, FIG. 2 depicts a relationship between a tube plate and an inner fin used in the method, as depicted in FIG. 1, and FIG. 3 depicts a heat transfer tube manufactured by the method.

The manufacturing method, as depicted in FIG. 1, comprises the following steps:

Step 1 (S1): An inner fin formed as a wave shape is not cut beforehand, and it is formed as a continuous, inner-fin forming material 3. Inner-fin forming material 3 is formed as a continuous material extending in a width direction W of a heat transfer tube to be formed, and wavy or undulating portions 1 and linear portions 2 are arranged alternately in continuous material 3 in width direction W of the heat transfer tube. A pair of tube plates 4*a* and 4*b*, which may be formed by pressing, are disposed so as to oppose each other. In this embodiment, a first end portions (i.e., right-side end portions in FIG. 1) of tube plates 4*a* and 4*b* in width direction W of the heat transfer tube are formed as linear end portions 6 extending linearly in an outward or lateral direction, without forming flanges. Inner-fin forming material 3 is fed continuously toward tube plates 4*a* and 4*b* in a direction shown by arrow 28.

Step 2 (S2): Inner-fin forming material 3 is inserted between the pair of tube plates 4*a* and 4*b* disposed to oppose each other, for forming inner fins 5. At that time, because inner-fin forming material 3 is fed to a predetermined extent, the positioning of material 3 between plates 4*a* and 4*b* may be carried out readily.

Step 3 (S3): Upper-side tube plate 4*b* is placed in contact with and over lower-side tube plate 4*a*, and linear portion 2 of inner-fin forming material 3 is nipped or seized by linear end portions 6 of tube plates 4*a* and 4*b*. At that time, because inner-fin forming material 3 remains as a continuous material, in which a portion forming inner fins 5 still is connected to a following inner-fin forming portion, the portion forming inner fins 5 does not shift in position.

Step 4 (S4): Stacked tube plates 4*a* and 4*b* and inner-fin forming material 3 then are cut simultaneously by a cutter 7 at a predetermined position. In this embodiment, tube plates 4*a* and 4*b* are temporarily secured to each other, simultaneously with this cutting.

Step 5 (S5): Cutter 7 is withdrawn or retracted, and a series of steps for manufacturing a heat transfer tube 8 with a predetermined width W are completed. If a plurality of heat transfer tubes are to be manufactured sequentially, the method returns to SI, and the series of S1–S5 are repeated.

In heat transfer tube 8 manufactured by this method, as depicted in FIG. 2, tube plates 4*a* and 4*b* and inner fin 5 are temporarily secured and integrated with each other. Inner fin 5 is fixed precisely at a predetermined position, relative to tube plates 4*a* and 4b.

Further, the cross-sectional shape of heat transfer tube 8 is formed, as depicted in FIG. 3. Although flange portions 10 are formed in a first end portion 9 of heat transfer tube 8 in its width direction:, in a second end portion 11 of heat transfer tube 8, linear portion 2 positioned at the end portion of inner fin 5 is nipped or seized between linear end portions 6 of tube plates 4*a* and 4*b* and temporarily secured and integrated with tube plates 4*a* and 4*b*. Therefore, inner fin 5 is fixed and desired at a predetermined position in a fluid passage 12 formed within heat transfer tube 8. A plurality of heat transfer tubes 8 thus manufactured may be assembled to form a stacking-type, multi-flow, heat exchanger, as depicted in FIG. 8, and assembled heat transfer tubes 8 may be integrated or fused by brazing in a furnace to complete a desired heat exchanger 31, as depicted in FIG. 8.

Figure 13:
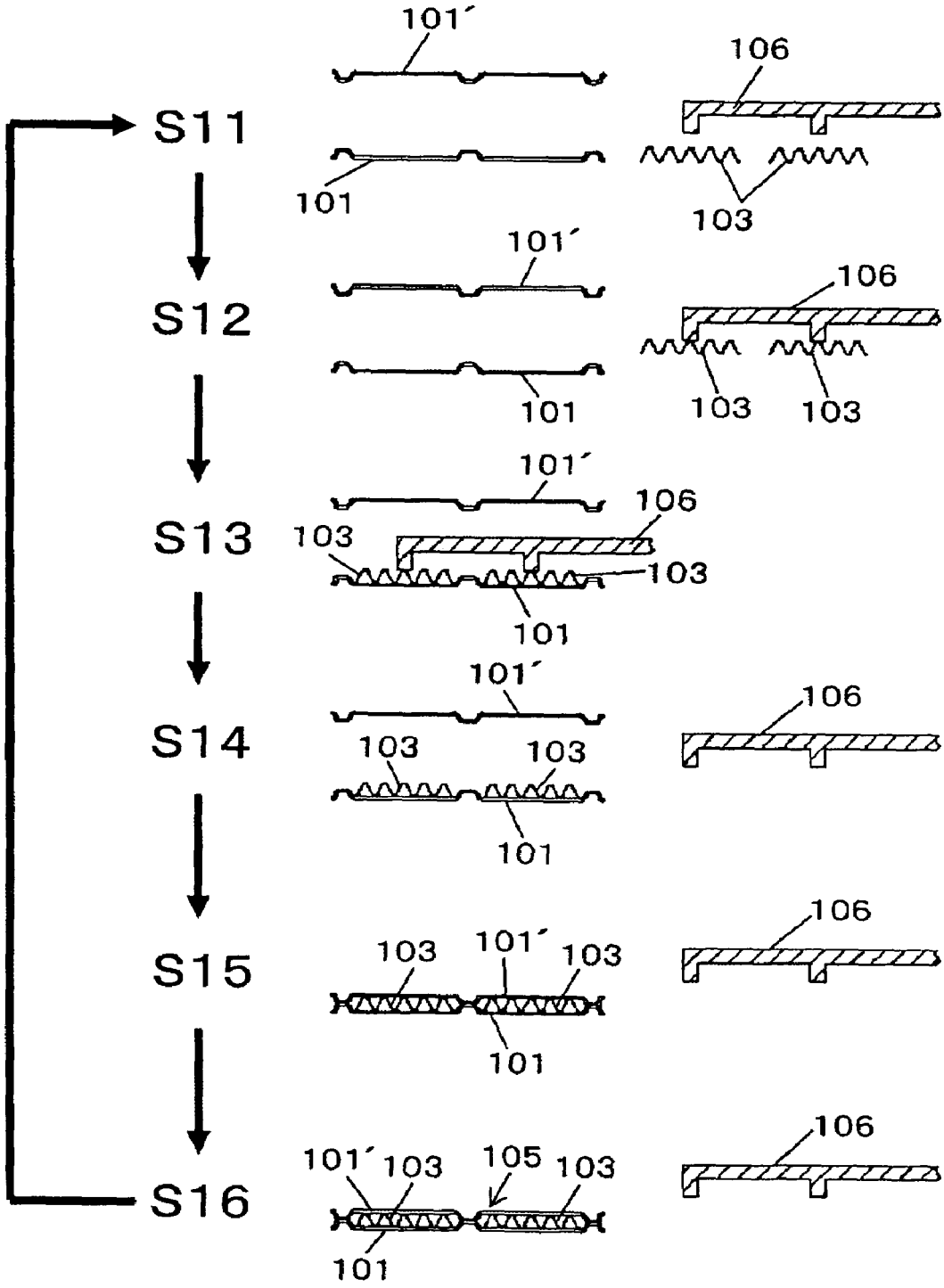
FIG. 13 PRIOR ART
FIG. 13 is a schematic diagram, showing steps for manufacturing a heat transfer tube in a known method for manufacturing a stacking-type, multi-flow, heat exchanger.

In the above-described first embodiment because the step for returning an inner fin insertion arm (shown as insertion arm 106 in FIG. 13), which is described in the known method, may be omitted, and, therefore, the time required to employ this insertion arm may be saved, the time required for manufacturing heat transfer tubes 8 may be reduced significantly. As a result, the productivity of methods for manufacturing stacking-type, multi-flow, heat exchangers may be increased.

Moreover, because an inner fin is inserted between tube plates 4*a* and 4*b* as a continuous inner-fin forming material 3, the positioning may be facilitated significantly, and the positioning accuracy may be increased significantly.

In addition, by stacking and covering one tube plate over the other tube plate before cutting inner-fin forming material 3, tube plates 4*a* and 4*b* may be temporarily and simultaneously secured by cutting the end portions of the tube plates and the inner-fin forming material. Consequently, a positional shift of an inner fin, which may occur in known processes, may be prevented.

Figure 4:
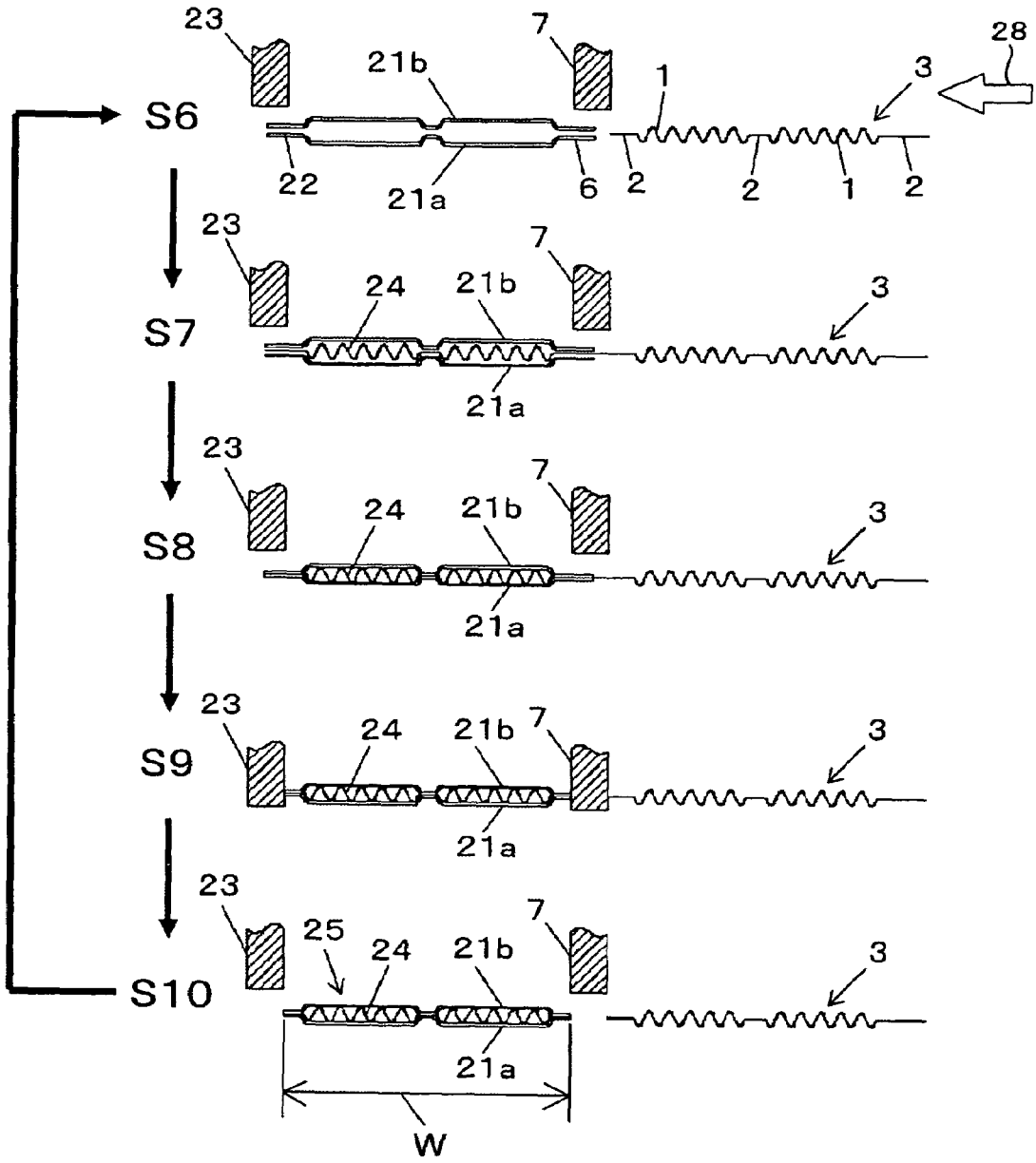
FIG. 4 is a schematic diagram, showing steps for manufacturing a heat transfer tube in a method for manufacturing a stacking-type, multi-flow, heat exchanger, according to a second embodiment of the present invention.
Figure 5:
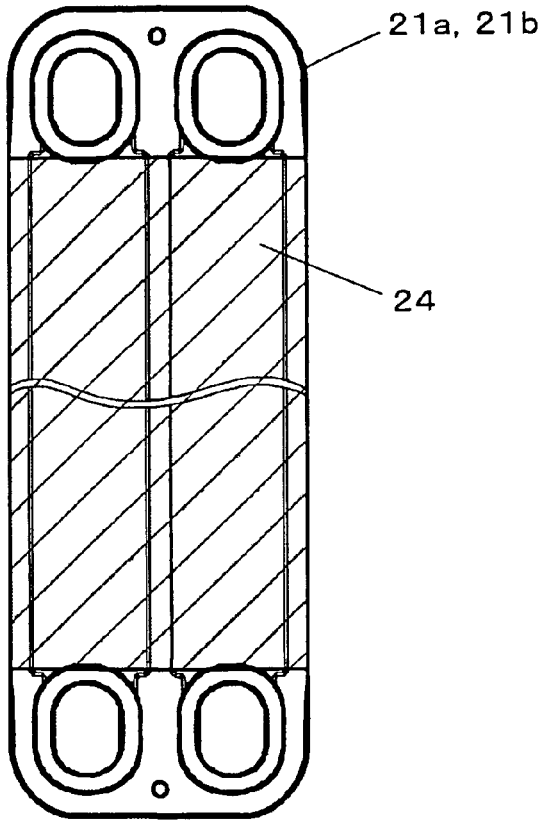
FIG. 5 is a plan view of a tube plate and an inner fin for use in the method depicted in FIG. 4.
Figure 6:
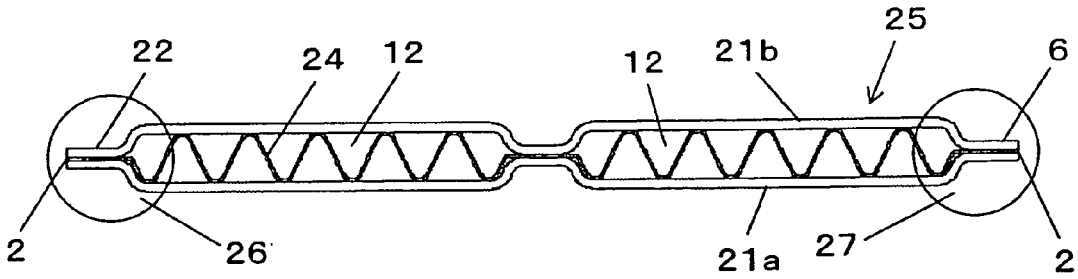
FIG. 6 is a cross-sectional view of a heat transfer tube manufactured by the method depicted in FIG. 4.

Although a step for cutting only one end portion of the tube plates is employed in the above-described first embodiment, steps for cutting both end portions of the tube plates may be employed, as shown in a second embodiment of the present invention, depicted in FIGS. 4–6.

The manufacturing method depicted in FIG. 4 comprises the following steps:

Step 6 (S6): A pair of tube plates 21*a* and 21*b*, which are formed by pressing, are disposed so as to oppose each other. In this embodiment, both end portions of tube plates 21*a* and 21*b* in a width direction W of a heat transfer tube are formed as linear end portions 6 and 22 extending linearly in outward or lateral directions, without forming flanges. Inner-fin forming material 3, formed as a continuous material having alternately arranged wavy or undulating portions 1 and linear portions 2, is fed between tube plates 21*a* and 21*b* in a direction shown by arrow 28.

Step 7 (S7): Inner-fin forming material 3 is inserted between the pair of tube plates 21*a* and 21*b*, which are vertically disposed to oppose each other in order to form inner fins 24. At that time, because inner-fin forming material 3 is fed to a predetermined extent, the positioning may be carried out readily.

Step 8 (S8): Second or upper-side tube plate 21*b* is positioned over first or lower-side tube plate 21*a*, and linear portions 2 of inner-fin forming material 3 are nipped or seized by linear end portions 6 and 22 of tube plates 21*a* and 21*b*. At that time, because inner-fin forming material 3 remains as a continuous material and because a portion forming inner fins 24 still is connected to a following inner-fin forming portion, the portion forming inner fins 24 does not shift in position.

Step 9 (S9): Stacked tube plates 21*a* and 21*b* and inner-fin forming material 3 are cut simultaneously by cutters 7 and 23 at respective, predetermined positions. In this embodiment, tube plates 21*a* and 21*b* are secured to each other temporarily and simultaneously by this cutting.

Step 10 (S10): Cutters 7 and 23 are withdrawn or retracted, and a series of steps for manufacturing a heat transfer tube 25 with a predetermined width W are completed. If a plurality of heat transfer tubes are manufactured sequentially, the method returns to S6, and the series of S6–S10 are repeated.

In heat transfer tube 25 manufactured by this method, as depicted in FIG. 5, tube plates 21*a* and 21*b* and inner fin 24 are temporarily secured and integrated with each other. Inner fin 24 is fixed precisely at a predetermined position, relative to tube plates 21*a* and 21*b*.

The cross-sectional shape of heat transfer tube 25 also is formed, as depicted in FIG. 6. Linear portions 2 positioned at the end portions of inner fin 24 are nipped or seized between linear end portions 22 and 6 of tube plates 21*a* and 21*b* at respective end positions 26 and 27 of heat transfer tube 25 in its width direction W. Inner fin 24 is temporarily secured and integrated within tube plates 21*a* and 21*b*. Therefore, inner fin 24 is fixed at a predetermined and desired position in fluid passage 12 formed in heat transfer tube 25. A plurality of heat transfer tubes 25 thus manufactured are assembled as a stacking-type, multi-flow, heat exchanger, as depicted in FIG. 8, and assembled heat transfer tubes 25 may be integrated or fused by brazing in a furnace to complete a desired heat exchanger 31, as depicted in FIG. 8.

In the above-described second embodiment, the time required for manufacturing heat transfer tubes 25 may be reduced significantly, and the productivity of methods for manufacturing a stacking-type, multi-flow, heat exchanger may be increased significantly. Further, because an inner fin is inserted between tube plates 21*a* and 21*b* as a continuous inner-fin forming material 3, the positioning of the inner fin may be facilitated significantly, and the positioning accuracy may be increased significantly. In particular, because the linear portions of inner-fin forming material 3 are nipped or seized at both sides in the width direction W of heat transfer tubes 25, the positioning of inner fin 24 may be achieved with more certainty. Moreover, tube plates 21*a* and 21*b* may be temporarily and simultaneously secured by cutting the end portions of the tube plates and the inner-fin forming material. Consequently, a positional shift of an inner fin, which may occur in known processes, may be prevented.

Figure 7A:
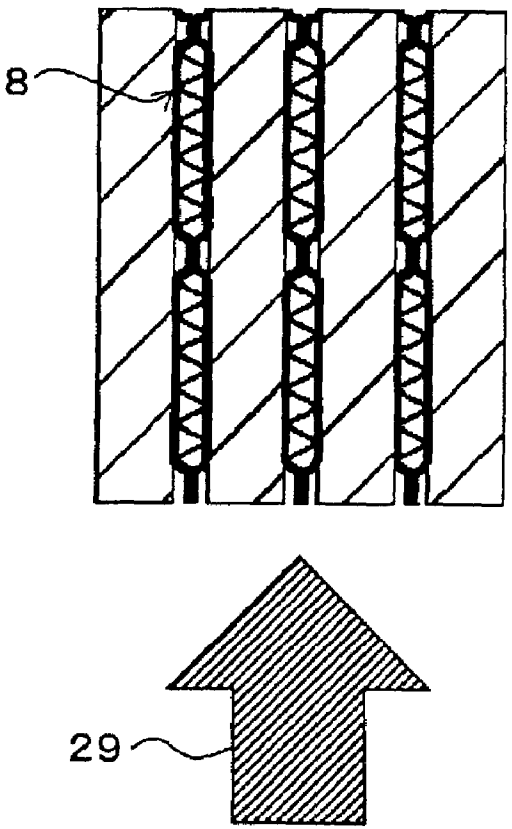
FIGS. 7A–7C are partial, cross-sectional views of heat exchangers manufactured using heat transfer tubes depicted in FIGS. 3 and 6, showing examples of the disposition of the heat transfer tubes.
Figure 7B:
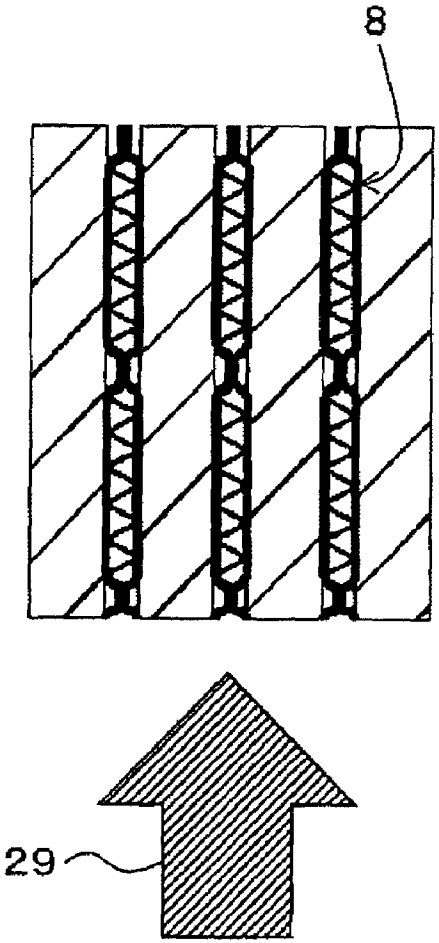
Figure 7C:
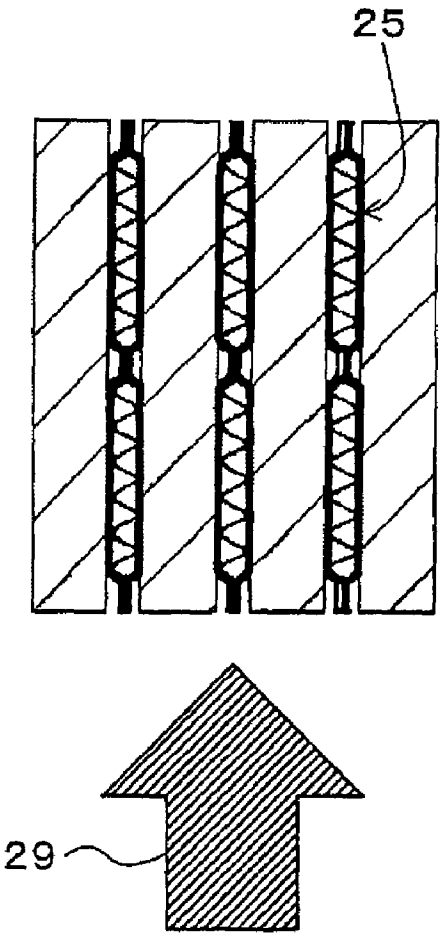

When a stacking-type, multi-flow, heat exchanger is manufactured using heat transfer tubes 8 or 25, such as those manufactured in the above-described first or second embodiment of the invention, the orientation of heat transfer tubes 8 or 25 may be employed variously. If heat transfer tubes 8, each having a linear end portion at one end in its width direction, are used, for example, as depicted in FIG. 7A or 7B; the linear end portions are disposed at either an upstream-side position (FIG. 7A) relative to air flow direction shown by arrow 29 or at a downstream-side position (FIG. 7B). If, however, heat transfer tubes 25, each having linear end portions at both ends in its width direction, are used, for example, as depicted in FIG. 7C; the linear end portions are present at both the upstream-side and downstream-side positions relative to air flow direction shown by arrow 29.

The present invention may be applied to any stacking-type, multi-flow, heat exchanger, which is formed with alternatively stacked heat transfer tubes and outer fins. The heat transfer fluid used in such heat exchangers, however, is not limited to refrigerant.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A method for manufacturing a stacking-type, multi-flow, heat exchanger comprising a plurality of heat transfer tubes and a plurality of outer fins, which are stacked alternately, each heat transfer tube being formed by connecting a pair of tube plates to form a fluid passage in each of heat transfer tubes, each of said heat transfer tubes comprising an inner fin, which extends in a longitudinal direction of said pair of tube plates, in said fluid passage, in said method comprising the steps of:

disposing said pair of tube plates so as to oppose each other;

inserting an inner-fin forming material between said pair of opposing tube plates;

stacking said pair of tube plates with respect to each other, so as to nip said inner-fin forming material between said pair of tube plates; and cutting said inner-fin forming material and edge portions of said pair of tube plates simultaneously.

2. The method of claim 1, wherein said stacked pair of tube plates are temporarily and simultaneously secured by said cutting.

3. The method of claim 1, wherein at least on edge portion of said each heat transfer tube in a width direction of said each heat transfer tube is formed as a shape linearly extending in an outward direction.

4. The method of claim 1, further comprising the steps of providing said inner-fin forming material as a portion of a continuous, material extending in a width direction of said each heat transfer tube, and after inserting said portion of said continuous material between said pair of opposing tube plates, cutting said continuous material and said edge portions of said pair of tube plates simultaneously.

5. The method of claim 4, further comprising the steps of arranging wavy portions and linear portions alternately on each portion of said continuous material in a width direction of said each heat transfer tube, and after inserting said continuous material between said pair of opposing tube plates, cutting said continuous material and said edge portions of said pair of tube plates simultaneously at a position of a linear portion of said continuous material.

6. The method of claim 4, further comprising the step of repeating the method steps to form a plurality of heat exchanger tubes.

* * * * *